United States Patent [19]

Schulz et al.

[11] Patent Number: 5,008,031

[45] Date of Patent: Apr. 16, 1991

[54] LIQUID DETERGENT

[75] Inventors: Paul Schulz, Wuppertal; Karl Schwadtke, Leverkusen, both of Fed. Rep. of Germany

[73] Assignee: Henkel Kommanditgesellschaft auf Aktien, Duesseldorf, Fed. Rep. of Germany

[21] Appl. No.: 323,637

[22] Filed: Mar. 15, 1989

[30] Foreign Application Priority Data

Mar. 16, 1988 [DE] Fed. Rep. of Germany ..... 3808695

[51] Int. Cl.[5] ..... C11D 3/44; C11D 3/18; C11D 3/20

[52] U.S. Cl. ..... 252/168; 252/94; 252/167; 252/170; 252/DIG. 14

[58] Field of Search ..... 252/DIG. 14, 162, 170, 252/167, 171, 168

[56] References Cited

U.S. PATENT DOCUMENTS

| | | | |
|---|---|---|---|
| 3,868,336 | 2/1975 | Mazzola et al. | 252/257 |
| 4,083,793 | 4/1978 | Jakobi et al. | 252/99 |
| 4,148,603 | 4/1979 | Schwuger et al. | 8/137 |
| 4,176,080 | 11/1979 | Wise et al. | 252/162 |
| 4,180,472 | 12/1979 | Mitchell et al. | 252/162 |
| 4,264,466 | 4/1981 | Carleton et al. | 252/99 |
| 4,622,173 | 11/1986 | Broze et al. | 252/528 |

FOREIGN PATENT DOCUMENTS

| | | |
|---|---|---|
| 3621536 | 1/1988 | Fed. Rep. of Germany . |
| 1318184 | 5/1973 | United Kingdom . |

*Primary Examiner*—William R. Dixon, Jr.
*Assistant Examiner*—Scott L. Hertzog
*Attorney, Agent, or Firm*—Ernest G. Szoke; Wayne C. Jaeschke; Real J. Grandmaison

[57] ABSTRACT

A liquid detergent based on nonionic and anionic surfactants, and optionally particulate builder materials, contains a non-surfactant component which increases the wash efficiency, comprising the combination of low-polarity and mid- to high-polarity organic liquids. The low-polarity liquids are hydrocarbons, while the mid- to high-polarity liquids are esters, ethers, ketones or alcohols. The detergents have a satisfactory viscosity behavior, good miscibility with water and good wash efficiency.

16 Claims, No Drawings

LIQUID DETERGENT

BACKGROUND OF THE INVENTION

1. Field of the Invention

The present invention relates to a liquid detergent based on nonionic and anionic surfactants as well as on particulate builder materials and containing additives, which are particularly effective in enhancing the wash efficiency as regards oily and greasy soils.

The use of nonionic surfactants in detergents serves primarily to improve their ability to clean oily and greasy soils. In free-flowing particulate detergents, however, the amount of customary liquid nonionic surfactants is limited by the capacity of the solid detergent constituents to take up or adsorb liquid constituents. In most cases, the free-flowing property of the detergent is decreased when nonionic liquid surfactants are used in an amount which is desirable. Furthermore, the nonionic surfactants are difficult to process in the hot spray method when used on a large scale in detergent manufacturing. Detergents having a high content of nonionic surfactants can, on the other hand, be manufactured without problems as anhydrous liquid to pasty detergents as described within the scope of this invention as liquid detergents. "Anhydrous" in this context, means that the detergents contain water, only in so far as the raw materials used for their manufacture themselves contain small amounts of water; in other words, water is not added to the detergent composition as a constituent of the formulation.

2. Discussion of Related Art

A liquid detergent based on nonionic surfactants and particulate builder materials is known from German patent application 36 21 536 which contains a liquid surfactant component of nonionic and anionic surfactants as well as polyethylene glycol having a molecular weight of approximately 200 to 600. Pursuant thereto, the addition of polyethylene glycol has the effect of improving the viscosity and speed of dissolution of the detergent. However, polyethylene glycol makes practically no contribution to the washing result. An object of the present invention was therefore the preparation of liquid detergents having satisfactory viscosity properties, high speed of dissolution and improved wash efficiency.

DESCRIPTION OF THE INVENTION

Other than in the operating examples, or where otherwise indicated, all numbers expressing quantities of ingredients or reaction conditions used herein are to be understood as modified in all instances by the term "about".

The subject of the present invention is therefore an anhydrous liquid detergent based on nonionic and anionic surfactants, and optionally, containing particulate builder materials, which is characterized in that it contains a non-surfactant component comprising the combination of low-polarity and mid- to high-polarity organic liquids, which improves the wash efficiency of the detergent composition. Low-polarity organic liquids in accordance with the present invention comprise aliphatic or cycloaliphatic, in particular, straight-chain or branched paraffin hydrocarbons having 8 to 40 carbon atoms, or mixtures of such hydrocarbons. It is important in the selection of suitable hydrocarbons within the scope of the present invention that they have a consistency which is from liquid to at the most, wax-like, at room temperature. A further essential characteristic for particularly suitable low-polarity organic liquids is the flash-point of the liquid, which, measured according to DIN 51 758, must exceed +40° C. An equally important characteristic for particularly suitable low-polarity organic liquids is the solidification point which should be at the most +10° C., measured according to DIN 51 583. If low-polarity organic liquids having a wax-like consistency at room temperature are used, then fluid liquids having a viscosity of less than 100 mPa.s, in particular of less than 50 mPa.s at 20° C., are suitable. Such corresponding liquid paraffin oils usually contain compounds having 8 to 20 carbon atoms.

Within the scope of the present invention suitable mid- to high-polarity liquids comprise compounds selected from the group consisting of esters, ethers, ketones, and alcohols. Particularly suitable esters include those derived from phthalic acid, adipic acid, fumaric acid, sebacic acid and trimellitic acid. The alcohol components of suitable esters include mono- or polyalcohols containing 1 to 8 carbon atoms. Di-butyl phthalate is an example of a particularly suitable ester.

Liquid detergents within the scope of the present invention having particularly balanced properties contain low-polarity components and mid- to high-polarity components in a weight ratio from 5:1 to 1:2, in particular, in a weight ratio of 1:1, in a quantity of 1 to 20% by weight, based on the entire detergent. Preferably, the content of these components, which improve the wash efficiency, amounts to 5 to 15% by weight, based on the entire detergent. A detergent with particularly balanced properties as regards its detergency performance, its viscosity and dissolving properties contains paraffin oil having 8 to 20 carbon atoms and di-butyl phthalate, preferably in a quantity from 8 to 12% by weight based on the entire detergent, particularly, a quantity of 10% by weight as non-surfactant components which improve the wash efficiency, wherein the weight ratio of the low-polarity to the mid- to high-polarity organic liquid lies in the range of 2:1 to 1:2, and in particular at 1:1.

Detergents according to the invention have a distinctly better detergency performance on fatty and cosmetic soils compared with prior art detergents which contain polyethylene glycol instead of the non-surfactant components according to the invention which improve the wash efficiency. In addition, if the detergents according to the invention contain a bleaching component or an enzyme, then soils which are bleachable or which contain albumen are also removed without difficulty. The foaming property in domestic washing machines of the detergent according to the invention is satisfactory.

The particulate builder materials optionally contained in the detergents according to the invention include organic and inorganic substances, preferably alkaline salts, in particular alkali metal salts, which are able not only to precipitate, or to sequester calcium ions, but also cause a synergistic increase of the wash efficiency with the surfactants and have a soil-dispersing or soil-suspending capacity. Of the inorganic salts, the water soluble alkali metaphosphates or alkali metal polyphosphates, in particular sodium polytriphosphate are of particular importance. Organic complexing agents for calcium ions and heavy metal ions may be present as well as these phosphates. Among these are compounds such as amino polycarboxylic acids, e.g. nitrilotriacetic acid, ethylenediamine tetraacetic acid, diethylenetriamine pentaacetic acid as well as their higher homologues. Suitable organic complexing agents containing phosphorus include the water soluble salts of the alkane polyphosphonic acids, amino- and hydroxy-alkane polyphosphonic acids and phosphonopolycarboxylic acids, such as for example the compounds methane diphosphonic acids, dimethylamino methane-1,1 -diphosphonic acids, amino trimethylene triphosphonic acids, ethylene diamine tetramethylene tetraphosphonic acids, diethylene triamine pentamethylene pentaphosphonic acids, 1-hydroxyethane-1,1-diphosphonic acids, and 2-phosphonobutane-1,2,4-tricarboxylic acids.

Of the organic builder materials, the N- and P-free polycarboxylic acids which form complex salts with calcium ions, to which polymerizates containing carboxyl groups also belong, are of particular importance. Low molecular weight compounds such as, e.g. citric acid, 2,2-oxydisuccinic acid and carboxy methyloxysuccinic acid are suitable. Suitable polymeric polycarboxylic acids have a molecular weight of from 350 to approximately 1,500,000 in the form of water soluble salts. Particularly preferred polymeric polycarboxylates have a molecular weight in the range of 500 to 175,000, and in particular in the range of 10,000 to 100,000. Among these are compounds such as, e.g. polyacrylic acid, poly-α-hydroxyacrylic acid, polymaleic acid as well as co-polymerizates of the corresponding monomeric carboxylic acids together or with ethylene unsaturated compounds, such as e.g. vinyl methylether. The water soluble salts of polyglyoxyl acids are also useful.

The finely-divided synthetic sodium aluminosilicates of the zeolite-A type containing bound water, more fully described in German Patent 24 12 837 as phosphate substitutes for detergents and cleaning agents are suitable as water insoluble inorganic builder materials. Cation-exchanging sodium aluminosilicates are introduced in their usual hydrated, finely crystalline form, i.e. they have practically no particles larger than 30 microns and preferably at least 80% of which consist of particles of a size less than 10 microns. Their calcium-binding capacity, which may be determined according to German Patent 24 12 837, lies between 100 and 200 mg CaO/g. Zeolite NaA is particularly useful, as is Zeolite NaX and mixtures of zeolite NaA and NaX.

Suitable inorganic, non-complexing salts include the bicarbonates, carbonates, borates, sulfates and silicates of the alkali metals, also described as "washing alkalis." Of the alkali metal silicates, the sodium silicates with a ratio $Na_2O:SiO_2$ of 1:1 to 1:3.5 are most useful.

Further builder materials which are used mainly in liquid compositions because of their hydrotropic properties include the salts of the non-capillary active sulfonic acids, carboxylic acids and sulfocarboxylic acids, containing 2 to 9 carbon atoms, for example the alkali metal salts of the alkane-, benzene-, toluene-, xylene- or cumene-sulfonic acids, sulfobenzoic acids, sulfophthalic acids, sulfoacetic acids, sulfosuccinic acids as well as the salts of acetic acid or lactic acid. Acetic amide and urea are also suitable as solubilizers.

Further constituents which may be contained, if desired, in the detergents according to the invention include anti-greying agents. Suitable anti-greying agents are cellulose ethers, such as carboxymethylcellulose, methylcellulose, hydroxyalkylcellulose, and mixed ethers such as methylhydroxyethylcellulose, methylhydroxypropylcellulose and methylcarboxymethylcellulose. Furthermore, mixtures of various cellulose ethers, in particular mixtures of carboxymethylcellulose and methylcellulose are suitable. As enzymes, those from the protease, lipase and amylase classes and mixtures thereof come into consideration. Particularly suitable are enzymatic active ingredients obtained from bacterial strains or fungi, such as bacillus subtilis, bacillus licheniformis and streptomyces griseus. In order to protect the enzymes against premature decomposition, normally they are embedded in coating substances.

The detergents according to the invention may also additionally contain constituents having a bleaching effect. The perhydrates and per-compounds customarily used in detergents and bleaches come into consideration as bleaching agents. Sodium perborate is a preferred perhydrate, commonly used as a monohydrate or, in particular, as a tetrahydrate. In addition, perhydrates of sodium carbonate (sodium percarbonate), of sodium pyrophosphate (perpyrophosphate), of sodium silicate (persilicate) as well as of urea can be considered. These perhydrates are preferably used together with bleach activators. Preferably, sodium perborate tetrahydrate and sodium perborate monohydrate in combination with bleach activators come into consideration as bleaching components. N-acyl compounds and 0-acyl compounds are particularly used as bleach activators. Examples of suitable N-acyl compounds are multiple acylated alkylene diamines, such as tetra-acetylmethylene diamine, tetra-acetyl ethylene diamine and their higher homologues, as well as acylated glycolurils, such as tetra-acetyl glycoluril. Further example s are Na-cyanimides, N-alkyl-N-sulphonylcarbonamides, N-acylhydantoins, N-acylated cyclic hydrazides, triazoles, urazoles, diketopiperazines, sulfurylamides, cyanurates and imidazolines. In addition to carboxylic acid anhydrides, such as phthalic acid anhydride and esters, such as Na-(iso)-nonanoylphenolsulfonate, acylated sugars, such as glucose penta-acetate can in particular be employed as O-acyl compounds. Preferred bleach activators are tetra-acetylethylene diamine and glucose penta-acetate. The bleach activators can also be covered with coating substances to avoid reaction with per-compounds or other substances, e.g. with enzymes. Detergent constituents of these types in the form of granulates, or granulates with coating substances lead to products with particularly valuable properties. By the particular composition of the detergent and by the presence of particulate constituents with two different ranges of particle size, a detergent with particularly high viscosity stability and sedimentation stability is obtained. The detergents according to the invention having a viscosity in the range of 1,000 to 1,000,000 mPa.s, measured with a Brookfield-RVT-viscosimeter using spindle No. 6 at 1 to 10 revolutions per minute and 20° C., are particularly preferred detergent compositions. In the range of approximately 1,000 to 10,000 mPa.s, the detergents can be poured and can therefore advantageously be filled for example into bottles, from which they are poured for use.

Detergents having a viscosity of more than 10,000 mPa.s have a particular handling advantage if the detergent is packed in doses in water soluble film bags. Particularly preferred embodiments are detergents which are contained in film bags based on polyvinyl alcohol. For handling, it is particularly advantageous in domestic detergents if the bags contain as much detergent as is needed to wash a full machine load. Suitable films include, for example, polyvinylalcohol films having a film thickness from 10 to 100 microns, e.g. 65 microns, which are formed by hot or wet sealing into sealed bags containing the detergent. A further advantageous packaging for high viscosity gel-like or pasty detergents, which can no longer be poured, are "forced supply" containers, for example, tubes, pump-dispensers or collapsible containers.

EXAMPLES

In an automatic domestic washing machine (Miele, Model W 716) textile samples soiled with test soils were washed together with 3.5 kg of normally soiled domestic washing in 60° C. (one-wash cycle). 150 g of detergent was used. The detergency performance of the detergent, which is composed as follows, was ascertained by the measurement of remission of the test-fabric at 460 nm. The removal of cosmetic soil (lipstick, make-up, mascara) was judged visually. In this evaluation, the number 6=original soil condition, and the number 1=soil has been totally removed.

The detergents had the following composition (in percentage by weight):

TABLE 1

| | Invention | Prior Art |
|---|---|---|
| Na-alkylbenzene sulfonate | 12.0 | 12.0 |
| Fatty alcohol-ethoxylate | 12.6 | 12.6 |
| Tripolyphosphate | 30.15 | 30.15 |
| Waterglass (silicate) | 5.0 | 5.0 |
| Methylcellulose/carboxymethyl cellulose | 0.5 | 0.5 |
| Optical brightener | 0.3 | 0.3 |
| Paraffin oil | 5.0 | — |
| Di-butylphthalate | 5.0 | — |
| Polydiol 300 | — | 10 |
| Silicon defoamer | 0.3 | 0.3 |
| Alkalase 2, O T | 0.8 | 0.8 |
| Perborate tetrahydrate | 25.0 | 25.0 |
| Soap | 2.9 | 2.9 |
| Dyestuff | 0.15 | 0.15 |
| Fragrance | 0.3 | 0.3 |

The detergency performance (% remission) is shown in Table 2.

TABLE 2

| Soil | Invention | Prior Art |
|---|---|---|
| Sebum/pigment | 66.0 | 63.6 |
| Bleachable soil | 60.3 | 57.9 |
| Protein soil | 76.9 | 75.3 |

The detergency performance (visual judgement) is shown in Table 3.

TABLE 3

| Soil | Invention | Prior Art |
|---|---|---|
| Cosmetic soil | 2.5 | 2.9 |

We claim:

1. An anhydrous liquid detergent consisting of nonionic and anionic surfactants present in a weight ratio of about 1:1 containing a solvent mixture consisting of the combination of low-polarity and mid- to high-polarity organic liquids, said low-polarity organic liquids being selected from an aliphatic and cycloaliphatic hydrocarbon having 8 to 40 carbon atoms, said mid-polarity to high-polarity organic liquids being selected from an ester, ether, ketone and alcohol, wherein the weight ratio of said low-polarity to said mid- to high-polarity organic liquids is from about 5:1 to about 1:2, said solvent mixture being present in a quantity of from about 1 to about 20% by weight, up to about 30% by weight of a particulate builder material, up to about 0.5% by weight of a cellulose ether, and up to about 25% by weight of a bleaching agent, based on the weight of said liquid detergent.

2. An anhydrous liquid detergent as in claim 1 wherein said low-polarity organic liquid has a flash point of more than about 40° C.

3. An anhydrous liquid detergent as in claim 1 wherein said low-polarity organic liquid has a solidification point of less than about 10° C.

4. An anhydrous liquid detergent as in claim 1 wherein said low-polarity organic liquid has a viscosity at about 20° C. of less than about 100 mPa.s.

5. An anhydrous liquid detergent as in claim 1 wherein said low-polarity organic liquid has a viscosity at about 20° C. of less than about 50 mPa.s.

6. An anhydrous liquid detergent as in claim 1 wherein said mid-polarity to high-polarity organic liquids are selected from an ester of phthalic acid, adipic acid, fumaric acid, sebacic acid and trimellitic acid.

7. An anhydrous liquid detergent as in claim 1 wherein said mid-polarity to high-polarity organic liquids comprise dibutyl phthalate.

8. An anhydrous liquid detergent as in claim 1 wherein the weight ratio of said low-polarity to said mid- to high-polarity organic liquids is about 1:1.

9. An anhydrous liquid detergent as in claim 1 wherein said solvent mixture is present in a quantity of from about 5 to about 15% by weight, based on the weight of said liquid detergent.

10. An anhydrous liquid detergent as in claim 1 wherein said solvent mixture comprises paraffin oil having about 8 to 20 carbon atoms and dibutyl phthalate.

11. An anhydrous liquid detergent as in claim 1 wherein said builder material comprises an alkali metal phosphate salt.

12. An anhydrous liquid detergent as in claim 1 wherein said builder material is selected from an amino polycarboxylic acid, nitrilo-triacetic acid, ethylenediamine tetraacetic acid, diethylenetriamine pentaacetic acid, and homologues thereof.

13. An anhydrous liquid detergent as in claim 1 wherein said builder material comprises a water-soluble salt selected from an alkane polyphosphonic acid, amino- and hydroxy-alkane polyphosphonic acid, and phosphonopolycarboxylic acid.

14. An anhydrous liquid detergent as in claim 1 wherein said builder material comprises an organic nitrogen-free and phosphorous-free polycarboxylic acid.

15. An anhydrous liquid detergent as in claim 1 wherein said builder material comprises a finely-divided, synthetic sodium aluminosilicate.

16. An anhydrous liquid detergent as in claim 1 wherein said builder material is selected from an alkali metal salt of a bicarbonate, carbonate, borate, sulfate and silicate.

* * * * *